US006027199A

United States Patent [19]

Reed

[11] Patent Number: 6,027,199

[45] Date of Patent: Feb. 22, 2000

[54] INK JET CARTRIDGE SYSTEM AND METHOD OF PRINTING USING PLURALITY OF SAME COLOR INKS WITH DIFFERENT INTENSITIES

[75] Inventor: William Henry Reed, Lexington, Ky.

[73] Assignee: Lexmark International, Inc., Lexington, Ky.

[21] Appl. No.: 08/994,804

[22] Filed: Dec. 19, 1997

[51] Int. Cl.[7] ..... B41J 2/205

[52] U.S. Cl. ..... 347/15; 347/43

[58] Field of Search ..... 347/15, 43, 86–87

[56] References Cited

U.S. PATENT DOCUMENTS

| | | | |
|---|---|---|---|
| 4,635,078 | 1/1987 | Sakurada et al. | 347/15 |
| 4,686,538 | 8/1987 | Kouzato | 347/15 |
| 4,692,773 | 9/1987 | Saito et al. | 347/15 |
| 4,713,746 | 12/1987 | Watanabe et al. | 347/15 |
| 4,860,026 | 8/1989 | Matsumoto et al. | 347/15 |
| 4,952,942 | 8/1990 | Kanome et al. | 347/15 |
| 5,648,801 | 7/1997 | Beardsley et al. | 347/15 |
| 5,777,634 | 7/1998 | Okamura et al. | 347/7 |
| 5,875,615 | 3/1999 | Ito et al. | 347/86 |

*Primary Examiner*—John Barlow
*Assistant Examiner*—Juanita Stephens
*Attorney, Agent, or Firm*—Jacqueline M. Daspit; Todd T. Taylor

[57] ABSTRACT

An ink jet cartridge system is used for printing a plurality of different inks onto a print medium. Each of the inks are of a same color but a different intensity (I) relative to each other ranging sequentially from I1 to IN, where N is the number of inks. A first cartridge includes it least two ink chambers, with each ink chamber in the first cartridge having one of the plurality of inks therein. The inks in the first cartridge include at least two inks with non-sequential intensities (I) and also include the ink having the intensity IN. A second cartridge includes at least two ink chambers, with each ink chamber in the second cartridge having one of the plurality of inks therein. The inks in the second cartridge include at least two inks with non-sequential intensities (I).

10 Claims, 2 Drawing Sheets

INK JET CARTRIDGE SYSTEM AND METHOD OF PRINTING USING PLURALITY OF SAME COLOR INKS WITH DIFFERENT INTENSITIES

BACKGROUND OF THE INVENTION

1. Field of the Invention

The present invention relates to an ink jet printer, and, more particularly, to an ink jet cartridge system and corresponding method of printing using a plurality of same color inks with different intensities.

2. Description of the Related Art

Ink jet printers, in known manner, typically are used to jet a plurality of different color inks onto raster lines in an image area overlying a print medium to generate a print image on the print medium. Ink dots for each color ink are placed at corresponding pixel locations with a placement resolution which varies depending upon physical constraints associated with the printhead and/or hardware used to move the printhead across the print medium.

For a particular color ink, it is known to vary the effective density of the ink dots placed on the print medium to thereby affect the apparent shade of the ink. For a black ink. This process of altering the effective density is known as gray scale printing. One known method of gray scale printing is to divide the image area into a plurality of super pixels, with each super pixel including a plurality of respective individual pixels. By placing a selected number of ink dots at certain pixel locations within the super pixel, while leaving the remaining pixel locations blank, a gray scale image having a selected apparent shade can be generated. A problem with this method of gray scale printing is that, depending upon the number of blank pixel locations within the super pixel, the generated image may appear grainy to the human eye. This graininess may be objectionable depending upon the particular application for which the print image is generated.

Another known method of gray scale printing also uses a plurality of super pixels and places a single color ink at selected ink dot placement locations within the super pixels.

Additionally, however, the size (or diameter) of each individual ink dot may also be varied to affect the overall density of the single color ink within the super pixel. This method of printing may help alleviate the problem of graininess in the generated print image.

Yet another known method of gray scale printing uses a single cartridge with two different inks of a same color but different intensity therein. The same color but different intensity inks have been found to provide improved gray scale printing by changing the actual intensity or shade of the color ink, rather than changing the apparent density on the print image by altering the ink dot size and/or placement locations.

What is further needed in the art is a method of printing with an ink jet printer which provides a print image with an improved effective density or gray scale of a particular color ink in a print image on a print medium.

SUMMARY OF THE INVENTION

The present invention provides an ink jet printer cartridge system having two multichamber cartridges with a same color but different intensity ink in each of the respective chambers of the two cartridges. The inks associated with one of the cartridges have respective intensities which may be selected, preferably non-sequentially from the plurality of inks used in both cartridges, such that only the one cartridge can be used and still provide a good print quality.

The invention comprises, in one form thereof, an ink jet cartridge system for printing a plurality of different inks onto a print medium. Each of the inks are of a same color but a different intensity (I) relative to each other ranging sequentially from I1 to IN, where N is the number of inks. A first cartridge includes at least two ink chambers, with each ink chamber in the first cartridge having one of the plurality of inks therein. The inks in the first cartridge include at least two inks with non-sequential intensities (I) and also include the ink having the intensity IN. A second cartridge includes at least two ink chambers, with each ink chamber in the second cartridge having one of the plurality of inks therein. The inks in the second cartridge include at least two inks with non-sequential intensities (I).

An advantage of the present invention is that either optimum printing may be carried out using both cartridges, or good printing may be called out using only one cartridge and thereby provide an increased throughput rate.

Another advantage is that a larger number of same color but different intensity inks may be used, thereby providing an image with improved colors.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
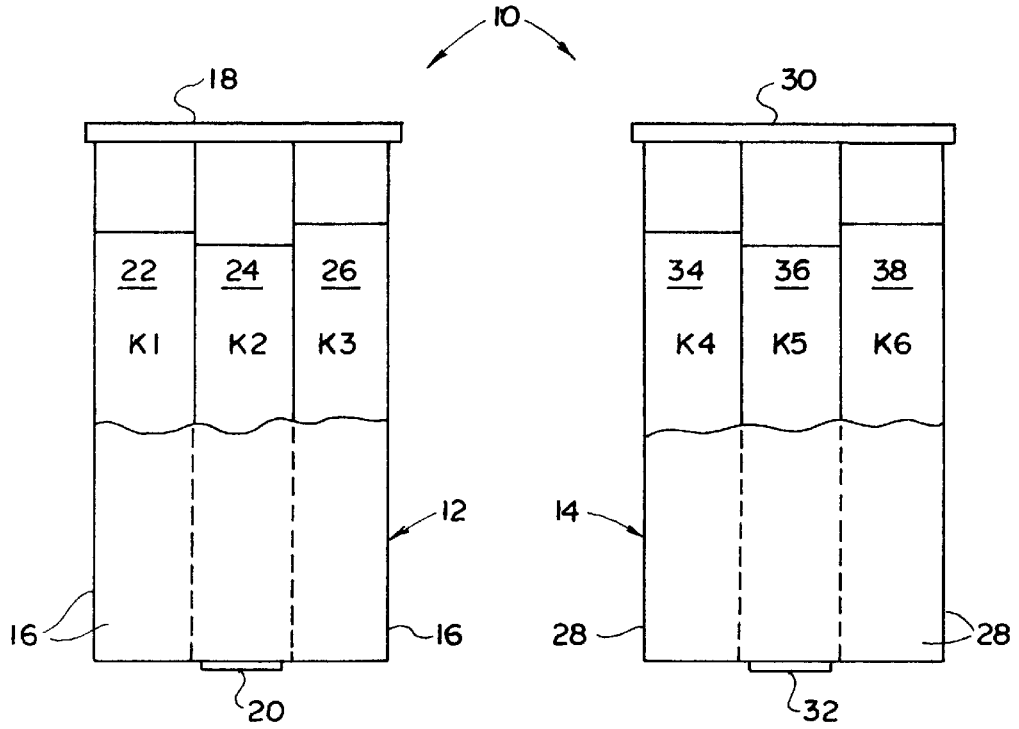
FIG. 1 is a fragmentary, schematic view of one embodiment of an ink jet cartridge system of the present invention.

Referring now to the drawings and particularly to FIG. 1, there is shown a fragmentary, schematic view of one embodiment of an ink jet cartridge system 10 of the present invention for printing a plurality of different inks onto a print medium (not shown). Ink jet cartridge system 10 includes a first cartridge 12 and a second cartridge 14. First cartridge 12 includes a plurality of sidewalls 16, a lid 18 and a printhead 20. Lid 18 is sealed with-sidewalls 16, in known matter. Printhead 20 includes a plurality of ink jetting orifices and a plurality of corresponding ink jetting heaters (not shown). More particularly, printhead 20 includes three separate arrays of ink jetting orifices which are typically arranged relative to each other in the advance direction of a print medium passing through the printer in which ink jet cartridge system 10 is installed.

First cartridge 12 includes three separate ink chambers 22, 24 and 26 therein which respectively hold different inks with intensities K1, K2 and K3. Each ink is disposed in fluid communication with a different array of ink jetting orifices in printhead 20, and has a fluid level at or below lid 18 (shown by respective horizontal lines in FIG. 1). Each ink in first cartridge 12 is of a same color but of a different intensity relative to each other. In the embodiment shown, each ink is a black ink of a different intensity relative to each other. For purposes of description, the intensity level of each ink is generally referenced "I"; however, for the particular embodiment shown in FIG. 1 the intensity levels are respectively labeled K1, K2 and K3 since the letter K typically corresponds to black ink. It will be appreciated however, that first cartridge 12 may include a different color ink which varies in intensity from one ink chamber to another, such as cyan, magenta or yellow ink.

Second cartridge 14 includes a plurality of sidewalls 28, a lid 30 and a printhead 32. Lid 30 is sealed with sidewalls 28, in known matter. Printhead 32 includes a plurality of ink jetting orifices and a plurality of corresponding ink jetting heaters (not shown). More particularly, printhead 32 includes three separate arrays of ink jetting orifices which are typically arranged relative to each other in the advance direction of a print medium passing through the printer in which ink jet cartridge system 10 is installed.

Second cartridge 14 includes three separate ink chambers 34, 36 and 38 therein which respectively hold different inks with intensities K4, K5 and K6. Each ink is disposed in fluid communication with a different array of ink jetting orifices in printhead 32, and has a fluid level at or below lid 30 (shown by respective horizontal lines in FIG. 1). Each ink in second cartridge 14 is of a same color but of a different intensity relative to each other and relative to the inks in first cartridge 12. In the embodiment shown, each ink in second cartridge 14 is a black ink of a different intensity relative to each other.

Ink jet cartridge system 40 includes a first cartridge 42 and a second cartridge 44. First cartridge 42 includes a plurality of sidewalls 46, a lid 48 and a printhead 50. Lid 44 is sealed with sidewall 16, in known matter. Printhead 50 includes a plurality of ink jetting orifices and a plurality of corresponding ink jetting heaters (not shown). More particularly printhead 50 includes three separate arrays of ink jetting orifices which are typically arranged relative to each other in the advance direction of a print medium passing through the printer in which ink jet cartridge system 40 is installed.

First cartridge 42 includes three separate ink chambers 52, 54 and 56 therein which respectively hold different inks with intensities K2, K4 and K6. Each ink is disposed in fluid communication with a different array of ink jetting orifices in printhead 50, and has a fluid level at or below lid 48 (shown by respective horizontal lines in FIG. 2). Each ink in first cartridge 42 is of a same color but of a different intensity relative to each other. Since the entire set of black inks used in both first cartridge 42 and second cartridge 44 have six different intensities ranging from K1–K6, the three black inks respectively disposed within ink chambers 52, 54 and 56 define a subset of inks having intensities which are nonsequential relative to each other. First cartridge 42 is also provided with the black ink having the darkest intensity K6 such that a truer black ink may be placed on the print medium at desired pixel locations using only first cartridge 42.

Second cartridge 44 includes a plurality of sidewalls 58, a lid 60 and a printhead 62. Lid 60 is sealed with sidewalls 58, in known manner. Printhead 62 includes a plurality of ink jetting orifices and a plurality of corresponding ink jetting heaters (not shown). More particularly, printhead 62 includes three separate arrays of ink jetting orifices which are typically arranged relative to each other in the advance direction of a print medium passing through the printers in which ink jet cartridge system 40 is installed.

Second cartridge 44 includes three separate ink chambers 64, 66 and 68 therein which respectively hold different inks with intensities K1, K3 and K5. Each ink is disposed in fluid communication with a different array of ink jetting orifices in printhead 62, and has a fluid level at or below lid 60 (shown by respective horizontal lines in FIG. 2). Each ink in second cartridge 44 is of a same color but a different intensity relative to each other and relative to the inks in first cartridge 42. The three different inks within ink chamber 64, 66 and 68 define a remaining subset of the number of inks having non-sequential intensities K1, K3 and K5, relative to the entire set of inks K1–K6 used in ink jet cartridge system 40.

Figure 3:
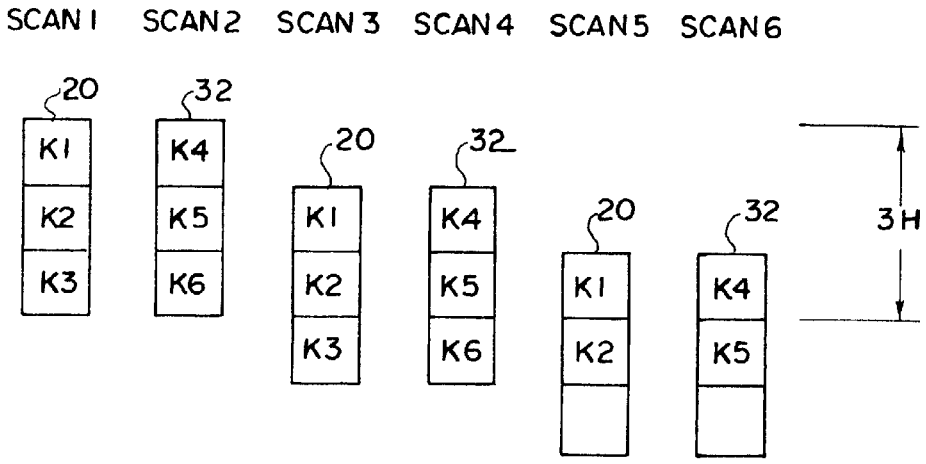
FIG. 3 illustrates an embodiment of a method of printing of the present invention using the ink jet cartridge system shown in FIG. 1.
Figure 4:
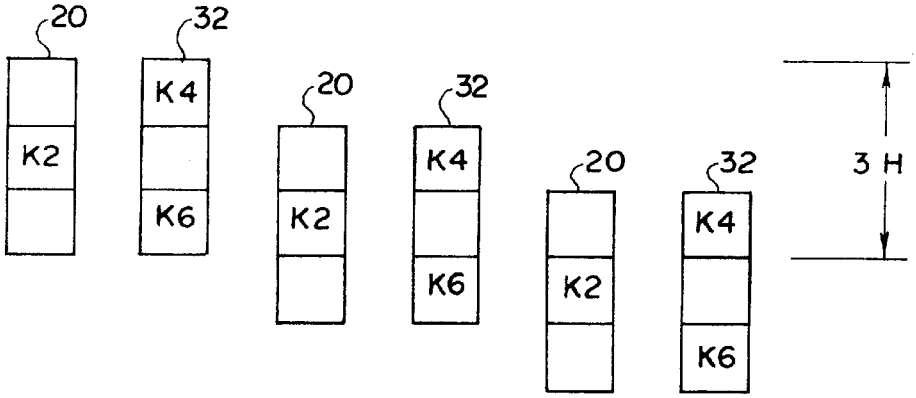
FIG. 4 illustrates another embodiment of a method of printing of the present invention using the ink jet cartridge system shown in FIG. 1.
Figure 5:
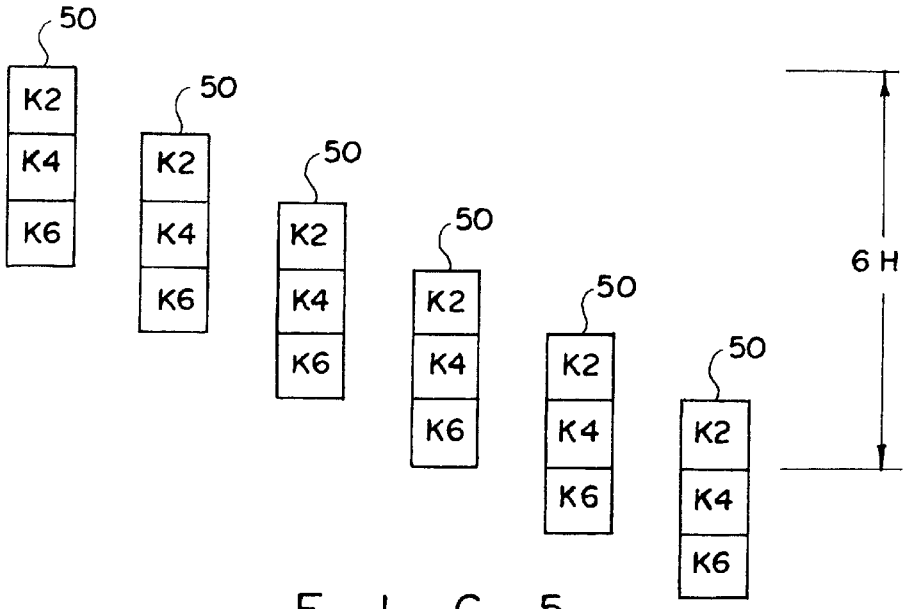
FIG. 5 illustrates a further embodiment of a method of printing of the present invention using the ink jet cartridge system shown in FIG. 2.

FIGS. 3–5 Illustrate different embodiments of the method of printing of the present invention. The scans of ink jet cartridge system 10 are referenced SCAN 1–SCAN 6 in FIG. 3, which likewise applies to FIGS. 4 and 5. Referring now specifically to FIG. 3, there is shown an embodiment of a method of printing of the present invention using ink jet cartridge system 10 shown in FIG. 1. Conventionally, an ink jet printer is typically provided with enough driver circuitry to drive one ink jet cartridge, when in fact the carriage assembly may carry two ink jet cartridges thereon. Driving both ink jet cartridges during a single scan across the print medium would in essence require that the electrical circuitry be duplicated within the printer, thereby increasing the cost and complexity of the printer. Thus, the method shown in FIG. 3 utilizes existing driver circuitry to provide the improved printing possible with the method of the present invention, while at the same time not increasing cost or complexity of the printer.

During a first scan (SCAN 1) across the print medium, printhead 20 of first cartridge 12 is used to jet ink at corresponding pixel locations on the print medium. Printhead 20 is shown in FIG. 3 as being divided into three vertically arranged areas corresponding to the three vertically arranged arrays of ink jetting orifices used to jet inks with intensities K1, K2 and K3 onto the print medium. During the first scan (i.e., SCAN 1), black ink of a first intensity K1 is jetted onto corresponding pixel locations as printhead 20 is scanned across the print medium. Similarly, black ink with a darker intensity K2 is jetted onto corresponding pixel locations as the printhead 20 is scanned across the print medium. Likewise, black ink having a yet darker intensity K3 is jetted onto corresponding pixel locations as printhead 20 is scanned across the print medium. During SCAN 2 (e.g., a return scan of ink jet cartridge system 10) printhead 32 is used to jet black ink having sequentially increasing intensities K4, K5 and K6 onto corresponding pixel locations as printhead 32 is scanned across the print medium.

Between SCAN 2 and SCAN 3, the print medium is advanced a distance corresponding to the height of each of the arrays used to jet the different intensity inks K1–K6 onto the print medium. Since printhead 20 and printhead 32 each include three arrays of ink jetting orifices, the distance which the print medium is advanced thus corresponds to approximately one-third the total height of either printhead 20 or printhead 32. Black inks having respective intensities K1, K2 and K3 are jetted onto pixel locations of the print medium during SCAN 3; and black ink having intensities K4, K5 and K6 are jetted onto pixel locations of the print medium from printhead 32 during SCAN 4. The printhead is again advanced a distance corresponding to approximately one-third the height of either printhead 20 or printhead 32 between SCAN 4 and SCAN 5. Printhead 20 is again used during SCAN 5, similar to SCAN 3 and SCAN 1; and printhead 32 is again used during SCAN 6, similar to SCAN 4 and SCAN 2. This process of using printhead 20 to place black inks having intensities K1, K2 and K3 onto the print medium; using printhead 32 to place black inks having intensities K4, K5 and K6 onto the print medium; and advancing the print medium a distance corresponding to one-third the height of either printhead 20 or printhead 32 is repeated until the desired print image is formed on the print medium.

As is apparent from FIG. 3, printhead 20 and printhead 32 are each advanced a distance corresponding to three times the advance distance of the print medium (i.e., 3H) after SCAN 6. This also corresponds to the height of the printhead 20 or 32. Since ink jet cartridge system 10 is scanned two times across the print medium before the print medium is advanced, the total advance distance traveled corresponds to one-half the total number of scans times the height of a single array of ink jetting orifices associated with K1–K6.

FIG. 4 illustrates another embodiment of a method of the present invention using ink jet cartridge system 10 shown in FIG. 1. The present inventors have found that while the method of printing shown in FIG. 3 provides optimum printing in terms of printing an image with multi-intensities, a good print image can nonetheless be achieved using a subset of the number of inks disposed within first cartridge 12 and second cartridge 14. In the embodiment shown, the darkest black ink having an intensity K6 is intentionally selected so that a truer black ink can be placed at selected pixel locations on a print medium. Assuming that the differences in intensity levels between the black inks having intensities K1–K6 in FIG. 1 is substantially linear, it may therefore be desirable to select two other black inks having intensities K2 and K4. In fact, the present inventors have found that when six black inks are used with a substantially linear difference in intensity levels therebetween, the black inks with intensities K2, K4 and K6 provide a good quality print image on the print medium.

The methodology carried out in FIG. 4 is similar to that described above with reference to FIG. 3. However, during SCAN 1, only the black ink having an intensity K2 is used in printhead 20. The black inks having intensities K1 and K3 are not used, and therefore the corresponding portions of printhead 20 shown in FIG. 4 are left blank. Likewise, during SCAN 2 only the black inks having intensities K4 and K6 are used to form the print image on the print medium. The black ink having an intensity K5 is not used during SCAN 2, and thus the corresponding portion of printhead 32 is left blank. The print medium is advanced a distance corresponding to approximately ⅓ the height of either printhead 20 or printhead 32 between SCANS 2 and 3 and between SCANS 4 and 5. SCANS 3 and 4, and SCANS 5 and 6 are each carried out similar to the methodology described above with reference to SCANS 1 and 2 in FIG. 4.

Figure 2:
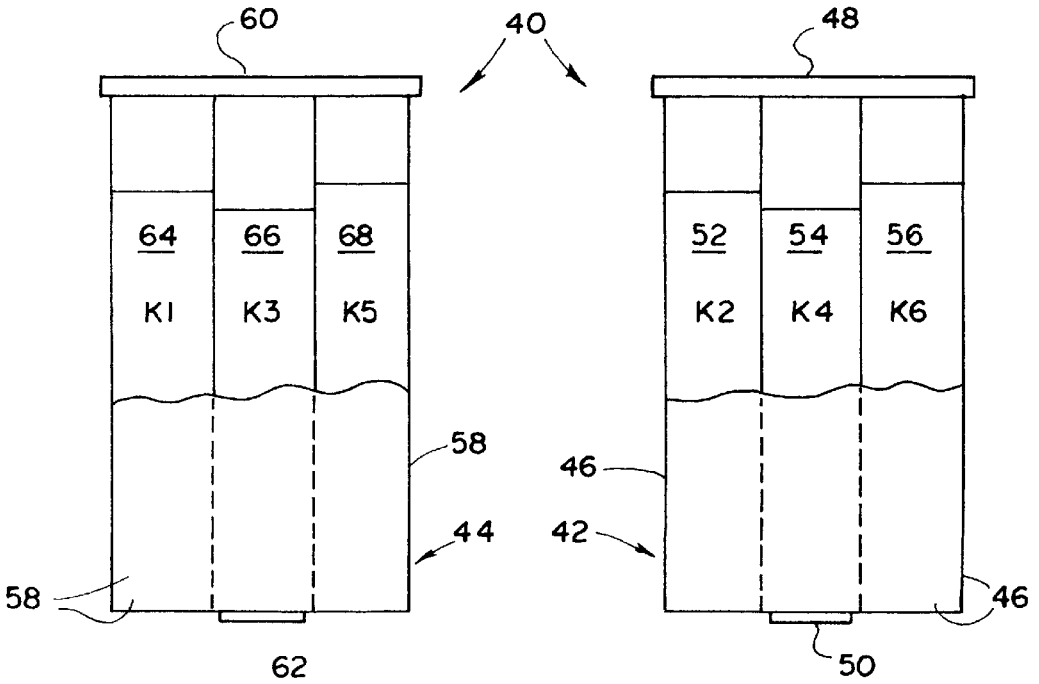
FIG. 2 is a fragmentary, schematic view of another embodiment of an ink jet cartridge system of the present invention.

Referring now to FIG. 5, there is shown yet another embodiment of a method of printing of the present invention using ink jet cartridge system 40 shown in FIG. 2. The method of printing shown in FIG. 5 is similar to the method of printing shown in FIG. 4 in that only the black inks having intensities K2, K4 and K6 are used to print a print image on the print medium. However, the method of printing shown in FIG. 5 primarily differs from the method of printing shown in FIG. 4 in that the black inks having intensities K2, K4 and K6 are placed on the print medium during a single scan of ink jet cartridge system 40, rather than in two scans as shown in FIG. 4. More particularly, since first cartridge 42 includes the three black inks having intensities K2, K4 and K6 within the respective ink chambers 52, 54 and 56, these particular black inks may be placed onto the print medium during a single scan of ink jet cartridge system 40 using only a single set of electrical driver circuitry. Thus, between scans of the ink jet cartridge system 40, the print medium may be advanced a distance corresponding to ⅓ the height of printhead 50. Accordingly, after six scans of ink jet cartridge system 40 using the method shown in FIG. 5, the paper has advanced a distance corresponding to six times the advance distance between scans (i.e., approximately two times the height of printhead 50). The method of printing shown in FIG. 5 therefore provides a throughput rate of the print medium which is substantially twice the throughput rate of the methods of printing shown in either FIG. 3 or FIG. 4.

In the methods of printing shown in FIGS. 3, 4 and 5, the print medium is advanced prior to an associated scan of the ink jet cartridge system 10 or 40 a distance corresponding to ⅓ the height of a respective printhead 20, 32 or 50. That is, the print medium is advanced such that each array of inkjetting orifices in printhead 20, 32 or 50 is vertically adjacent to the position of the same array of ink jetting orifices in a previous scan. However, it will also be appreciated that the methods of printing shown in FIGS. 3, 4 and 5 using ink jet cartridge systems 10 or 40 may also be carried out using interlaced or shingled printing.

The method of printing of the present invention may favorably be applied to applications where only a single color image with a relatively high contrast is necessary. For example, the method of printing of the present invention may be used in medical applications to print out a print image representing a scan of a portion of a body of a patient, such as a CAT scan or the like. Of course, many other wide and varied applications are also possible.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of printing on a print medium with an ink jet printer, comprising the steps of:

providing at least four inks of a same color but a different intensity (I) relative to each other ranging sequentially from I1 to IN, where N is the number of inks;

selecting a subset of the number of inks which provides a good print quality said selected subset of inks including at least two inks with non-sequential intensities (I) and also including said ink having the intensity IN;

defining a remaining subset of the number of inks, said remaining subset of inks not including any inks in said selected subset of inks;

providing a first cartridge including at least two ink chambers, each said ink chiamber of said first cartridge respectively including one of said inks in said selected subset of inks therein;

providing a second cartridge including at least two ink chambers, each said ink chamber in said second cartridge respectively including one of said inks in said remaining subset of said inks therein; and printing on the print medium using said first cartridge.

2. The method of printing of claim 1, wherein said step of providing the plurality of inks comprises providing six inks, and wherein each of said first cartridge and said second cartridge include three chambers.

3. The method of printing of claim 2, wherein said first cartridge includes three of the six inks having intensities 12, 14 and 16, and wherein said second cartridge includes three of the six inks having intensities 11, 13 and 15.

4. The method of printing of claim 1, wherein said step of providing the plurality of inks comprises providing a plurality of black inks.

5. The method of printing of claim 1, wherein said printing step comprises printing on a raster of the print medium using only said first cartridge.

6. An ink jet cartridge system for printing a plurality of different inks onto a print medium, each of the inks being of a same color but a different intensity (I) relative to each other ranging sequentially from I1 to IN, where N is the number of inks, said ink jet cartridge system comprising:

a first cartridge including at least two ink chambers, each said ink chamber in said first cartridge having a different one of the plurality of inks therein, said inks in said first cartridge including at least two inks with non-sequential intensities (I) and also including said ink having the intensity IN; and a second cartridge including at least two ink chambers, each said ink chamber in said second cartridge having one of the plurality of inks therein, said inks in said second cartridge being different from each other and from said inks in said first cartridge, said inks in said second cartridge including at least two inks with non-sequential intensities (I).

7. The ink jet cartridge system of claim 6, wherein the plurality of inks consists of six inks, and wherein each of said first cartridge and said second cartridge include three chambers.

8. The irk jet cartridge system of claim 7, wherein said first cartridge includes three of the six inks having intensities 12, 14 and 16, and wherein said second cartridge includes three of the six inks having intensities 11, 13 and 15.

9. The ink jet cartridge system of claim 6, wherein each of the plurality of inks is a black ink.

10. An ink jet catridge system for printing a plurality of same color but different intensity inks onto a print medium, said ink jet cartridge system comprising:

a first cartridge including at least two ink chambers, each said ink chamber in said first cartridge having one of the plurality of inks therein, each said ink in said first cartridge being of the same color but a different intensity relative to each other; and a second cartridge including at least two ink chambers, each said ink chamber in said second cartridge having one of the plurality of inks therein, each said ink in said second cartridge being of the same color but a different intensity relative to each other and to the inks in said first cartridge wherein the plurality of same color inks consists of six inks, wherein each of said first cartridge and said second cartridge include three chambers, wherein said first cartridge includes three of the six inks having intensities I2, I4, I6, and wherein said second cartridge includes three of the six inks having intensities I1 I3, and 15.

* * * * *